United States Patent [19]

Rashid et al.

[11] 4,082,885

[45] Apr. 4, 1978

[54] FIRE RESISTANT ASPHALT ROOFING SHINGLES

[75] Inventors: Sheikh A. Rashid, Chicago; Hugh S. Bray, Mount Prospect; Edward J. Boarini, Arlington Heights, all of Ill.

[73] Assignee: United States Gypsum Company, Chicago, Ill.

[21] Appl. No.: 701,841

[22] Filed: Jul. 1, 1976

Related U.S. Application Data

[63] Continuation of Ser. No. 537,286, Dec. 30, 1974, abandoned.

[51] Int. Cl.[2] ..... E04D 1/00

[52] U.S. Cl. ..... 428/281; 52/518; 427/390 D; 427/417; 428/283; 428/291; 428/323; 428/325; 428/332; 428/440; 428/489; 428/920

[58] Field of Search ..... 428/141-145, 428/210, 241, 281, 283, 291, 323, 325, 404, 406, 421, 440, 489, 920, 921; 52/518; 427/390 D, 417

[56] References Cited

U.S. PATENT DOCUMENTS

| | | | |
|---|---|---|---|
| 1,913,667 | 6/1933 | Harshberger | 428/143 |
| 2,302,183 | 11/1942 | Burns | 428/143 |
| 2,326,724 | 8/1943 | Fasold et al. | 428/143 |
| 2,490,430 | 12/1949 | Greider et al. | 428/143 |
| 2,610,928 | 9/1952 | Greider et al. | 428/143 |
| 3,231,453 | 1/1966 | Smith | 428/143 |

*Primary Examiner*—James J. Bell

*Attorney, Agent, or Firm*—Glenn W. Ohlson; Samuel Kurlandsky; Robert H. Robinson

[57] ABSTRACT

A fire resistant and weathering resistant shingle or surface covering material ecologically desirable in its utilization of disposable glass is disclosed. The shingle has an asphalt coating with specified characteristics, and the asphalt coating contains from 10 to 55% by weight granular glass and preferably a combination of granular glass and non-glass granular mineral filler a major portion of which is granular glass, with each having a specified particle size distribution.

A process is disclosed for producing a fire-resistant shingle or surface covering. The process includes saturating a felt base with a bitumen, admixing asphalt with granular glass and preferably with a specified combination of granular glass and non-glass granular mineral filler of specified characteristics, and then coating at least one side of the saturated felt with the filled asphalt.

6 Claims, No Drawings

FIRE RESISTANT ASPHALT ROOFING SHINGLES

This is a continuation of application Ser. No. 537,286, filed Dec. 30, 1974, now abandoned.

BACKGROUND OF THE INVENTION

1. Field of the Invention

This invention relates to a fire resistant asphalt base covering more commonly referred to as asphalt shingles. The shingle is ecologically desirable because it utilizes disposable glass as a filler material.

2. Description of the Prior Art

Asphalt roofing shingles have been utilized in the building industry for many years. Such roofing shingles must meet many specifications in order to qualify for label approval. For instance, a Class A label has strict requirements relating to flame exposure, spread of flame, and burning brand. Class B requirements are less severe, and Class C requirements are still lower.

Generally, the type of shingle discussed herein comprises a felt base saturated with a bitumen and coated on at least one side with a filled asphalt coating. Fillers for asphalt coatings have varied tremendously in the past. It has been recognized that the filler can be a member of a broad group of inorganic mineral materials including carbonates, such as limestone, mica, slate flour, diatomaceous earth and other such things. Generally, this filler is finely ground for addition to the asphalt coating, but a critical particle size distribution has not been established or deemed critical in the production of the asphalt coating. Glass fillers have heretofore been used as part of the inorganic mineral filling in asphalt coatings. The glass fillers, however, have generally been of the spun glass or glass fiber type and have not in the past been used in specific amounts with a specific particle size distribution. The only attempts to use glass with other inorganic mineral fillers includes those attempts wherein glass is first fused with the other mineral material, such as a carbonate, and then broken up for addition to the asphalt coating. Singularly or in combination, all of the known prior filled asphalt coatings do not include the particular embodiment of granular glass of a particular particle size distribution or of a combination of granular glass of a particular particle size distribution with a non-glass granular mineral filler likewise of a particular particle size distribution.

SUMMARY OF THE INVENTION

It is an object of this invention to provide a fire resistant and weathering resistant shingle or surface covering material ecologically desirable in its utilization of disposable glass.

It is another object of this invention to provide an improved coating composition which can be applied by the use of conventional equipment and yet have the same fire resistant and weathering resistant properties of Class A shingles.

It is a further object of this invention to provide a process for providing a fire resistant and weathering resistant shingle or surface covering material ecologically desirable in its utilization of disposable glass.

The objects of this invention are accomplished by a fire resistant and weathering resistant shingle or surface covering material ecologically desirable in its utilization of disposable glass, said shingle comprising a felt base sheet saturated with a bitumen and coated on at least one side with a filled asphalt coating, said asphalt coating prior to its filling having a penetration of from 5 to 40 mm. at 77° F. and a softening point of from 180° F. to 250° F., said filled asphalt having granular glass therein in an amount from 10 to 55% by weight, based on the weight of the asphalt, said granular glass having a particle size distribution of

| Sieve Analysis (U.S. Std. Screen) Cumulative | Wt. % Range |
|---|---|
| 60 mesh | .2 to 20 |
| on 80 mesh | 2 to 29 |
| on 100 mesh | 4 to 35 |
| on 140 mesh | 14 to 46 |
| on 200 mesh | 34 to 61 |
| on 325 mesh | 70 to 90 |
| through 325 mesh | remainder, |

and said filled asphalt coating comprising from about 25 to about 45% by weight of the finished shingle.

In an important embodiment of this invention, the objects of this invention are accomplished by a fire resistant and weathering resistant shingle or surface covering material ecologically desirable in its utilization of disposable glass, said shingle comprising a felt base sheet saturated with a bitumen and coated on at least one side with a filled asphalt coating, said asphalt coating prior to its filling having a penetration of from 5 to 40 mm. at 77° F. and a softening point of from 180° F. to 250° F., said filled asphalt having a combination of granular glass and non-glass granular mineral filler, therein in an amount of from 10 to 55% by weight, based on the weight of the asphalt, of said granular glass and said non-glass granular mineral filler each having a particle size distribution of

| Sieve Analysis (U.S. Std. Screen) Cumulative | Wt. % Range |
|---|---|
| 60 mesh | .2 to 20 |
| on 80 mesh | 2 to 29 |
| on 100 mesh | 4 to 35 |
| on 140 mesh | 14 to 46 |
| on 200 mesh | 34 to 61 |
| on 325 mesh | 70 to 90 |
| through 325 mesh | remainder, |

said granular glass comprising a major portion by weight of the combination of granular glass and non-glass granular mineral filler and said filled asphalt coating comprising from about 25% to about 45% by weight of the finished shingle.

In a still another embodiment of this invention, the non-glass granular material is a carbonate such as limestone.

The objects of this invention are further accomplished by a process for producing a fire-resistant and weathering resistant shingle or surface covering material ecologically desirable in its utilization of disposable glass, said process comprising:

A. saturating a felt base with a bitumen;

B. admixing heated, workable asphalt with granular glass, said asphalt having a penetration of from about 5 to 40 mm. at 77° F. and a softening point of from 180° F. to 250° F., said granular glass being admixed with the asphalt in an amount of from 10% to 55% by weight of the asphalt, and said granular glass having a particle size distribution of

| Cumulative | Sieve Analysis (U.S. Std. Screen) Wt. % Range |
|---|---|
| on 60 mesh | .2 to 20 |
| on 80 mesh | 2 to 29 |
| on 100 mesh | 4 to 35 |
| on 140 mesh | 14 to 46 |
| on 200 mesh | 34 to 61 |
| on 325 mesh | 70 to 90 |
| through 325 mesh | remainder; and |

C. coating at least one side of the saturated felt with the filled asphalt until the filled asphalt comprises from about 25% to about 45% by weight of the finished material.

The objects of this invention are further accomplished by the embodiment comprising a process for producing a fire resistant and weathering resistant shingle or surface covering material ecologically desirable in its utilization of disposable glass, said process comprising:

A. saturating a felt base with a bitumen;

B. admixing asphalt with a combination of granular glass and non-glass granular mineral filler, said asphalt having a penetration of from about 5 to 40 mm. at 77° F. and a softening point of from 180° F. to 250° F., said combination of granular glass and non-glass granular mineral filler being admixed with the asphalt in an amount of from 10 to 55% by weight of the asphalt, said combination of granular glass and non-glass granular mineral filler having granular glass as a major portion thereof, and said granular glass and non-glass granular mineral filler each having a particle size distribution of

| Cumulative | Sieve Analysis (U.S. Std. Screen) Wt. % Range |
|---|---|
| on 60 mesh | .2 to 20 |
| on 80 mesh | 2 to 29 |
| on 100 mesh | 4 to 35 |
| on 140 mesh | 14 to 46 |
| on 200 mesh | 34 to 61 |
| on 325 mesh | 70 to 90 |
| through 325 mesh | remainder; and |

C. coating at least one side of the saturated felt with the filled asphalt until the filled asphalt comprises from about 25% to about 45% by weight of the finished material.

In still another embodiment of the above described process, the non-glass granular material is a carbonate such as limestone.

It is of particular importance to this invention that it has the capability of utilizing ground glass originating in disposable bottles and the like. Disposable bottles have become a serious ecological problem in that they are not degradable and tend to provide a permanent type of pollution when disposed of improperly. Generally, such glass material does not warrant the reprocessing required for refilling of the containers because of cost considerations. This invention utilizes this glass material regardless of type and origin and also regardless of condition, i.e. whether it is broken or not, because the glass is first granulated to a specified particle size distribution. Not only does the glass utilization provide sound ecological advantages, but it also provides a conventional asphalt shingle combination which has good fire resistance. It also provides a shingle which has good weather resistance and wears well. Unlike prior compositions using spun glass, this composition utilizes glass which needs only be processed by cleaning, subdivision, and screening to a particular particle size distribution. Also, unlike prior compositions, this invention is capable of utilizing large quantities of disposable glass as a filler in the asphalt coating of roofing shingles.

This invention can utilize granular glass as the sole filler for the asphalt coating thereby providing a shingle of increased wearability. Although it is not necessary to include non-glass granular mineral material as a filler, such is usually preferred for cost considerations even though the wearability of the shingle thus produced is slightly decreased.

The felt base material of this invention is the type normally used in asphalt roofing shingles and is formed generally from paper rags, asbestos, mineral wool, etc., or a fibrous insulation board in accordance with the usual practice. It is apparent, however, that other suitable sheet-like base materials may be used, either fibrous or non-fibrous, either foraminous or non-foraminous, and either deformed or non-deformed that are adapted to afford the desired strength characteristics. Included in the term of a felt base are such things as woven fabrics or fabrics of unspun bonded fibers. Ordinary roofing felt made of organic fibers is, however, the most inexpensive sheet material and notwithstanding the combustibility of such sheet material, roofing comprising it can, according to this invention, be made highly fire resistant.

The asphalt used in this invention is of the type normally utilized in the coating of asphalt shingles and must have a penetration of from 5 to 40 mm. at 77° F. and a softening point of from 180° F. to 250° F. If these ranges are substantially violated the coating will not have the proper workability to absorb the granular glass and the product will not perform adequately under fire test conditions.

The asphalt coating must have between 10 and 55% by weight granular glass and non-glass granular mineral filler therein. If less than the amount of this material is included, then the fire resistant and weathering resistant properties of the shingles will be substantially diminished. If greater than the amount of required glass is added then there is insufficient amount of asphalt material to prepare an adequate product.

The particle size distribution of the glass and non-glass granular material in this invention is of critical importance and deviation therefrom produces an unacceptable product. Specifically, the weathering properties and overall product quality will be substantially affected by substantial deviation from the particle size distribution.

The saturated felt must be coated on at least one side with the felt asphalt until the felt asphalt comprises from 25 to about 45% by weight of the finished material. Substantial deviation from the lower amount of asphalt produces a product not having sufficient weathering and fire retention properties. Substantial deviation above the 45% range will cause the finished material to be too susceptible to running upon heating and thereby will cause poor fire resistant properties.

DESCRIPTION OF THE PREFERRED EMBODIMENTS

This invention may be more fully explained and defined by the following examples which are not intended as a limitation on the invention since there are obviously a number of adaptations, extensions, variations and permeations that can readily be considered as within the spirit of this invention, as defined by the hereunto appended claims.

EXAMPLE 1

A conventional felt of the type normally used in asphalt shingles was saturated with asphalt of a standard type to produce the base for a conventional asphalt roofing shingle. A collection of disposable bottles was ground to give a particle size distribution as follows:

| Cumulative | Particle Size Distribution (U.S. Std. Screen) Wt. % |
|---|---|
| on 60 mesh | 19.7 |
| on 80 mesh | 28.05 |
| on 100 mesh | 34.25 |
| on 140 mesh | 46.00 |
| on 200 mesh | 46.10 |
| on 325 mesh | 78.30 |
| through 325 mesh | 98.90 |

Asphalt having a penetration of about 30 mm. at 77° F. and a softening point of about 235° F. was heated until it was soft and workable. The ground glass was thoroughly mixed with the asphalt to give a filled asphalt coating material. The asphalt coating material was then applied to the saturated felt base until the filled asphalt comprised about 40% by weight of the finished material. Upon cooling, the resulting asphalt shingle had good fire resistance properties. Weatherometer tests were conducted on the shingle according to the test of ASTM-D529 (1971). Using twenty-six or more pinholes on a standard test specimen of $2\frac{3}{4}$ inches $\times$ $5\frac{7}{8}$ inches as a failure point, the shingle reached 166 average cycles before failure, an improvement of 67.8% over the same shingle not having a filler and an improvement of 13.15% over a shingle using only a carbonate as a filler.

EXAMPLE 2

Example 1 was repeated with the exception that the disposable glass was replaced with a commercially produced glass not made into bottles but ground to have a particle size distribution as follows:

| Cumulative | Particle Size Distribution (U.S. Std. Screen) Wt. % |
|---|---|
| on 60 mesh | 4.50 |
| on 80 mesh | 12.80 |
| on 100 mesh | 20.65 |
| on 140 mesh | 37.45 |
| on 200 mesh | 48.30 |
| on 325 mesh | 78.10 |
| through 325 mesh | 99.75 |

Again, the resulting shingle had good fire resistance and weathering properties, matching the weatherometer tests in Example 1.

EXAMPLE 3

A conventional felt of the type normally used in asphalt shingles was saturated with asphalt of a standard type to produce the base for a conventional asphalt roofing shingle. A collection of disposable bottles was ground to give a particle size distribution as follows:

| Cumulative | Particle Size Distribution Wt. % |
|---|---|
| on 60 mesh | 19.7 |
| on 80 mesh | 28.05 |
| on 100 mesh | 34.25 |
| on 140 mesh | 46.00 |
| on 200 mesh | 46.10 |
| on 325 mesh | 78.30 |
| through 325 mesh | 98.90 |

A limestone carbonate was divided until it had a particle size distribution as follows:

| Cumulative | Particle Size Distribution Wt. % |
|---|---|
| on 60 mesh | 1.80 |
| on 80 mesh | 5.80 |
| on 100 mesh | 10.70 |
| on 140 mesh | 24.25 |
| on 200 mesh | 35.60 |
| on 325 mesh | 78.20 |
| through 325 mesh | 98.25 |

Asphalt having a penetration of about 30 mm. at 77° F. and a softening point of about 235° F. was heated until it was soft and workable. Six parts by weight of the ground glass and four parts by weight carbonate were mixed and added to the asphalt until it comprised about 50% by weight of the asphalt to give a filled asphalt coating material. The asphalt coating material was then applied to the saturated felt base until the filled asphalt comprised about 40% by weight of the finished material. Upon cooling, the resulting asphalt shingle had good fire resistance. Weatherometer tests were conducted on the shingle according to the test of ASTM-D529. Using twenty-six or more pinholes as a failure point, the shingle reached 162 average cycles before failure, an improvement of 63.7% over the same shingle not having a filler and an improvement of 6.7% over a shingle using only the carbonate as a filler.

EXAMPLE 4

Example 3 was repeated with the exception that the disposable glass was replaced with a commercially produced glass not made into bottles but ground to have a particle size distribution as follows:

| Cumulative | Particle Size Distribution Wt. % |
|---|---|
| on 60 mesh | 4.50 |
| on 80 mesh | 12.80 |
| on 100 mesh | 20.65 |
| on 140 mesh | 37.45 |
| on 200 mesh | 48.30 |
| on 325 mesh | 78.10 |
| through 325 mesh | 99.75 |

Again, the resulting shingle had good fire resistance and weathering properties, matching the weatherometer tests in Example 1.

Example 1 represents the preferred embodiment of this invention.

The improved fire resistant and weathering resistant shingles of this invention are highly acceptable in that they utilize large amounts of disposable glass which is currently producing an ecological problem. The utilization of this glass material with its particular particle size distribution is of importance in that it provides an asphalt shingle or the like having properties competitive with other known asphalt shingles. This invention therefore is new and novel and supplies an excellent product for fulfilling a long felt need.

What is claimed is:

1. A fire resistant and weathering resistant shingle or surface covering material ecologically desirable in its utilization of disposable glass, said shingle comprising a felt base sheet saturated with a bitumen and coated on at least one side with a filled asphalt coating, said asphalt coating prior to its filling having a penetration of from 5 to 40 mm. at 77° F. and a softening point of from 180° F. to 250° F., said filled asphalt having granular glass therein in an amount of from 10% to 55% by weight, based on the weight of the asphalt, said granular glass having a particle size distribution of

| Sieve Analysis (U.S. Std. Screen) Cumulative | Wt. % Range |
|---|---|
| 60 mesh | .2 to 20 |
| on 80 mesh | 2 to 29 |
| on 100 mesh | 4 to 35 |
| on 140 mesh | 14 to 46 |
| on 200 mesh | 34 to 61 |
| on 325 mesh | 70 to 90 |
| through 325 mesh | remainder, |

and said filled asphalt coating comprising from about 25 to about 45% by weight of the finished shingle.

2. A process for producing a fire resistant and weathering resistant shingle or surface covering material ecologically desirable in its utilization of disposable glass, said process comprising:

A. saturating a felt base with a bitumen;

B. admixing heated, workable asphalt with granular glass, said asphalt having a penetration of from about 5 to 40 mm. at 77° F. and a softening point of from 180° F. to 250° F., said granular glass being admixed with the asphalt in an amount of from 10 to 55% by weight of the asphalt, and said granular glass having a particle size distribution of

| Sieve Analysis (U.S. Std. Screen) Cumulative | Wt. % Range |
|---|---|
| on 60 mesh | .2 to 20 |
| on 80 mesh | 2 to 29 |
| on 100 mesh | 4 to 35 |
| on 140 mesh | 14 to 46 |
| on 200 mesh | 34 to 61 |
| on 325 mesh | remainder; and |

C. coating at least one side of the saturated felt with the filled asphalt until the filled asphalt comprises from about 25 to about 45% by weight of the finished material.

3. A fire resistant and weathering resistnat shingle or surface covering material ecologically desirable in its utilization of disposable glass, said shingle comprising a felt base sheet saturated with a bitumen and coated on at least one side with a filled asphalt coating, said asphalt coating prior to its filling having a penetration of from 5 to 40 mm. at 77° F. and a softening point of from 180° F. to 250° F., said filled asphalt having a combination of granular glass and non-glass granular mineral filler therein in an amount of from 10 to 55% by weight, based on the weight of the asphalt, said granular glass and said non-glass granular mineral filler each having a particle size distribution of

| Sieve Analysis (U.S. Std. Screen) Cumulative | Wt. % Range |
|---|---|
| 60 mesh | .2 to 20 |
| on 80 mesh | 2 to 29 |
| on 100 mesh | 4 to 35 |
| on 140 mesh | 14 to 46 |
| on 200 mesh | 34 to 61 |
| on 325 mesh | 70 to 90 |
| through 325 mesh | remainder, |

said granular glass comprising a major portion by weight of the combination of granular glass and non-glass granular mineral filler, and said filled asphalt coating comprising from about 25% to about 45% by weight of the finished shingle.

4. A fire-resistant and weathering resistant shingle or surface covering material as in claim 3 wherein the non-glass granular material is a carbonate.

5. A process for producing a fire resistant and weathering resistant shingle or surface covering material ecologically desirable in its utilization of disposable glass, said process comprising:

A. saturating a felt base with a bitumen;

B. admixing asphalt with a combination of granular glass and non-glass granular mineral filler, said asphalt having a penetration of from about 5 to 40 mm. at 77° F. and a softening point of from 180° F. to 250° F., said combination of granular glass and non-glass granular mineral filler being admixed with the asphalt in an amount of from 10 to 55% by weight of the asphalt, said combination of granular glass and non-glass granular mineral filler having granular glass as a major portion thereof, and said granular glass and non-glass granular mineral filler each having a particle size distribution of

| Sieve Analysis (U.S. Std. Screen) Cumulative | Wt. % Range |
|---|---|
| on 60 mesh | .2 to 20 |
| on 80 mesh | 2 to 29 |
| on 100 mesh | 4 to 35 |
| on 140 mesh | 14 to 46 |
| on 200 mesh | 34 to 61 |
| on 325 mesh | 70 to 90 |
| through 325 mesh | remainder; and |

C. coating at least one side of the saturated felt with the filled asphalt until the filled asphalt comprises from about 25 to about 45% by weight of the finished material.

6. A process as in claim 5 wherein the non-glass granular material is a carbonate.

* * * * *